US005921770A

United States Patent [19]

Sattelmayer

[11] Patent Number: 5,921,770

[45] Date of Patent: Jul. 13, 1999

[54] BURNER FOR OPERATING A COMBUSTION CHAMBER WITH A LIQUID AND/OR GASEOUS FUEL

[75] Inventor: Thomas Sattelmayer, Mandach, Switzerland

[73] Assignee: ABB Research Ltd., Zurich, Switzerland

[21] Appl. No.: 08/975,301

[22] Filed: Nov. 20, 1997

[30] Foreign Application Priority Data

Dec. 23, 1996 [DE] Germany ..... 196 54 116

[51] Int. Cl.[6] ..... F23D 14/62

[52] U.S. Cl. ..... 431/352; 431/285; 431/351; 431/354

[58] Field of Search ..... 431/354, 284, 431/285, 351, 352

[56] References Cited

U.S. PATENT DOCUMENTS

| | | | |
|---|---|---|---|
| 2,665,748 | 1/1954 | Cornelius | 431/352 |
| 3,951,584 | 4/1976 | Thekdi | 431/352 |
| 3,975,141 | 8/1976 | Sweet | 431/352 |
| 5,489,203 | 2/1996 | Dobbeling et al. | 431/284 |
| 5,727,938 | 3/1998 | Knopfel | 431/285 |

FOREIGN PATENT DOCUMENTS

| | | |
|---|---|---|
| 0321809B1 | 5/1991 | European Pat. Off. . |
| 0436113A1 | 7/1991 | European Pat. Off. . |
| 0704657A2 | 4/1996 | European Pat. Off. . |
| 758974 | 1/1934 | France . |

*Primary Examiner*—Carroll B. Dority
*Attorney, Agent, or Firm*—Burns, Doane, Swecker & Mathis, L.L.P.

[57] ABSTRACT

In a burner for operating a combustion chamber with a liquid and/or gaseous fuel (12, 16), the combustion air (7) required for this purpose is directed through tangential air-inlet ducts (5, 6) into an interior space of the burner. This directing of the flow results in a swirl flow in the interior space, which swirl flow induces a backflow zone at the outlet of the burner. In order to stabilize the flame front forming there, at least one zone (27) is provided at each sectional body (1, 2) forming the burner, within which zone (27) inlet openings (29) are provided for the injection of supplementary air (32) into the swirl flow (7*a*). Due to this injection, a film forms at the inner wall of the sectional bodies (1, 2), which film prevents the flame from being able to flashback along the inner wall of the sectional bodies (1, 2) into the interior space of the burner.

9 Claims, 3 Drawing Sheets

FIG. 4
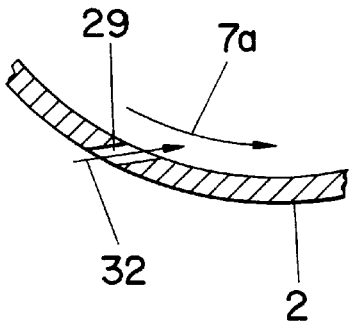
FIG. 5
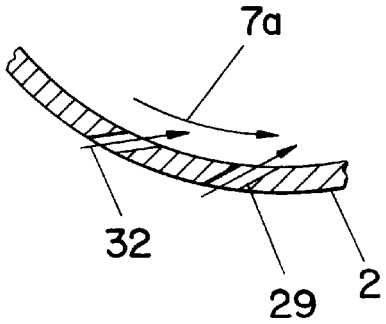
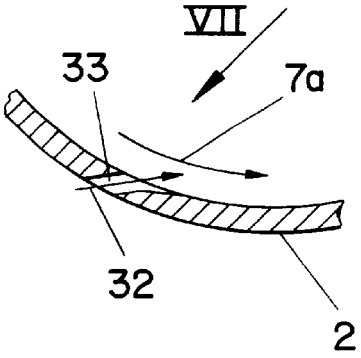
FIG. 6
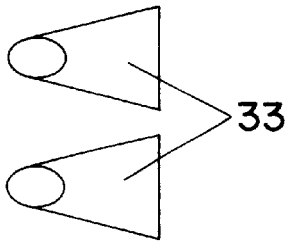
FIG. 7

BURNER FOR OPERATING A COMBUSTION CHAMBER WITH A LIQUID AND/OR GASEOUS FUEL

BACKGROUND OF THE INVENTION

1. Field of the Invention

The present invention relates to a burner for premix combustion of liquid and gaseous fuels.

2. Discussion of Background

In burners for premix combustion of liquid and/or gaseous fuels, the migration of the flame into the burner, also called flashback of the flame, constitutes a major problem. In addition, the aerodynamics in the case of these burners have to be designed in such a way that local zones which have a long retention time and in which the fuel/air mixture may ignite (=self-ignition) are avoided. If a swirl flow is generated in such a way that high peripheral velocities occur in the vicinity of the axis, for example when radial swirl registers are used, the axial velocity in the center is low. Since high degrees of turbulence occur at the same time, the flame may spread out against the direction of flow and it then migrates into the burner, as a result of which overheating problems generally occur. In practice, this leads to restrictions in the choice of swirl generation. The generation of a swirl-flow field requires the flow to be enclosed in a space, the best space being rotationally symmetrical. The outer limit of this space causes a flow boundary layer which always has the condition of disappearing velocity at the wall. The same applies to fuel lances fitted in the center. The portion of the mixture which flows directly along the wall will be retained for an undesirably long time in the burner. Especially low velocities occur at the outer limit of the swirl-flow field, since, at constant total pressure in the arrangement, the static pressure increases from inside to outside, whereby the dynamic pressure, which is represented by the absolute velocity, becomes lower and lower with increasing radius. These low velocities may possibly no longer prevent the flame from being propagated from the combustion space along the boundary layer into the burner and from then overheating and destroying the latter.

U.S. Pat. No. 4,932,861 to Keller et al. has disclosed a burner which represents under premix conditions for liquid and/or gaseous fuels the solution which has become best known up to now in this field in order to be able to remove the abovementioned shortcomings without the implementation of additional features.

However, development in gas-turbine construction is aimed at substantially increasing the compressor pressure ratios, so that the reliability of the abovementioned burner is automatically reduced for the said reasons.

SUMMARY OF THE INVENTION

Accordingly, one object of the invention, as defined in the claims, is to provide in a burner of the type mentioned at the beginning novel measures which are able to reliably prevent a flashback of the flame.

The essential advantage of the invention may be seen in the fact that this additional feature is of the simplest design and can be fitted in the said burner as and when required without having to interfere with and thus alter the basic conception of the same, whereby such a burner, which has already proved itself extremely well at average compressor pressure ratios, may also be adopted and used for the further development stages of gas turbines.

According to the invention, supplementary air is injected along the burner walls, preferably, to be precise, in the second half of the burner on the outflow side. This supplementary air forms a film along the wall and it then mixes slowly with the main flow enriched with fuel. The substantial improvement in safety against a flashback is effected on the basis of two principles. On the one hand, an important factor is that the mixture is diluted. Since the burner is operated close to its lean extinction limit, even weak local dilution of the mixture along the walls leads to the desired loss of combustibility of the mixture along the walls. On the other hand, this supplementary air can be injected in such a way that the axial velocity is increased along the wall, a factor which likewise has a favorable effect for the operation of such a burner. In general, the impulse-density ratio between film air and main flow is in the region of 1, since both flows are frequently accelerated from the same total pressure. Other impulses are also readily conceivable; yet, they have no negative effects on the intended action.

Advantageous and expedient developments of the achievement of the object according to the invention are defined in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 shows a configuration of a single row of injection openings, FIG. 5 shows a configuration of a double row of injection openings, and FIGS. 6, 7 show a special design of the individual injection openings.

DESCRIPTION OF THE PREFERRED EMBODIMENTS

Figure 1:
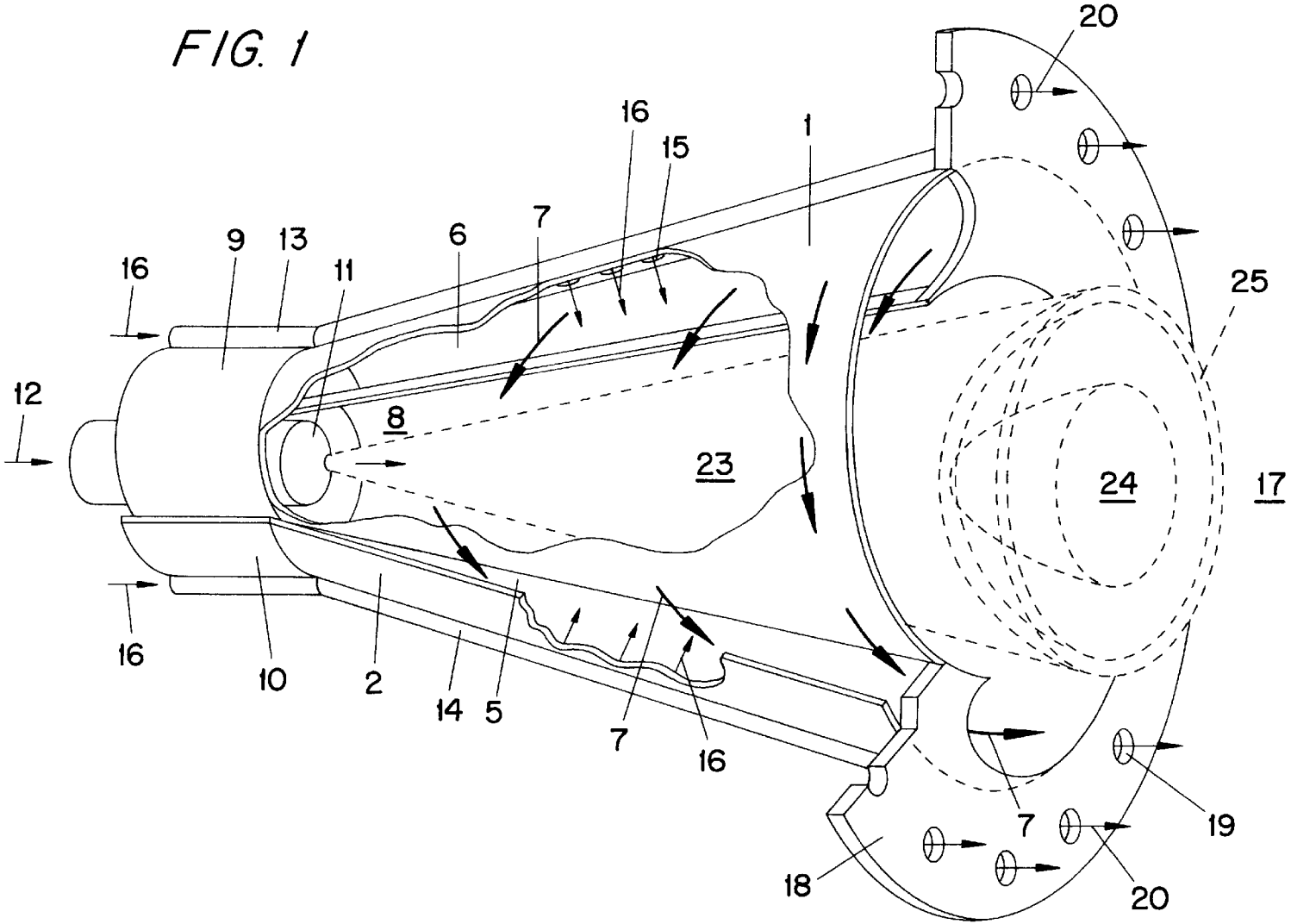
FIG. 1 shows a perspective representation of a burner suitable for premix combustion by formation of a swirl flow.
Figure 2:
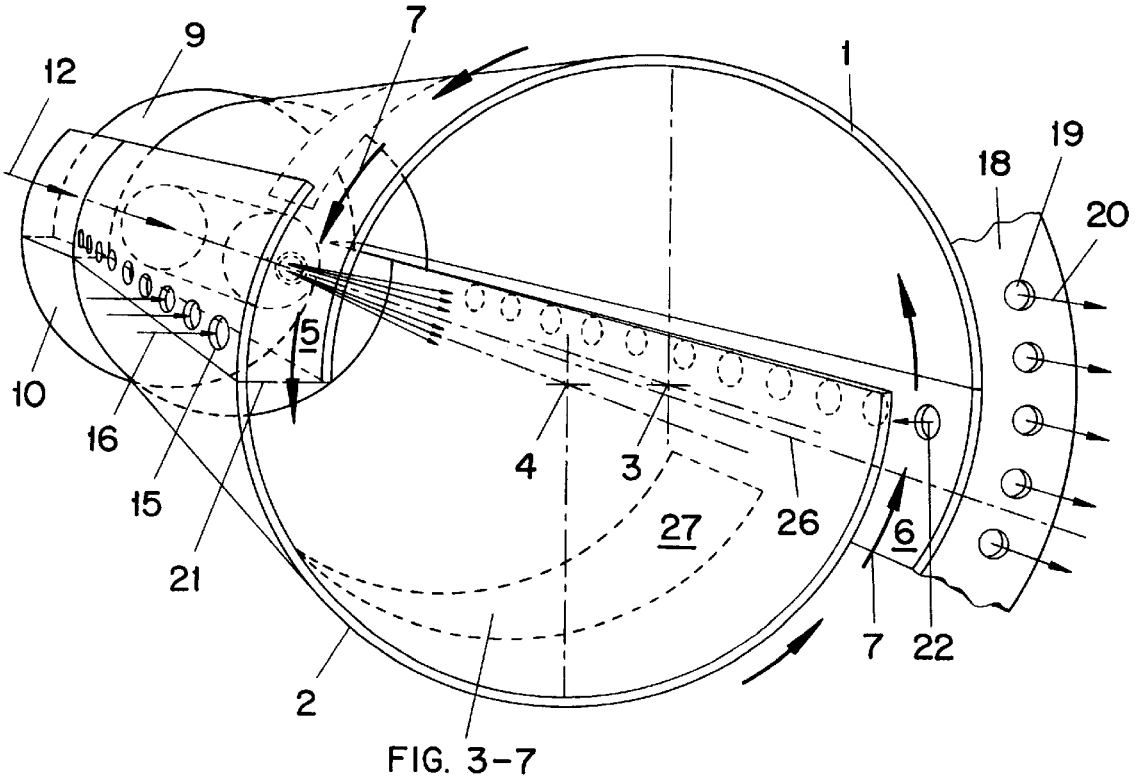
FIG. 2 shows a further perspective representation of this burner in another view in simplified form.

Referring now to the drawings, wherein like reference numerals designate identical or corresponding parts throughout the several views, all elements not required for directly understanding the invention have been omitted and the direction of flow of the media is indicated by arrows, FIG. 1 shows a burner in perspective representation. In order to better understand the subject matter, it is of advantage if FIG. 2 is also used at the same time when studying FIG. 1 with the aid of the description.

The burner according to FIG. 1 consists of two hollow conical sectional bodies 1, 2 which are nested one inside the other in a mutually offset manner. Here, the expression "conical" not only refers to the conical shape shown, which is characterized by a fixed opening angle, but also includes other configurations of the sectional bodies, thus a diffuser shape or diffuser-like shape as well as a confuser shape or confuser-like shape. These shapes are not additionally shown here, since they are readily familiar to the person skilled in the art. The mutual offset of the respective center axis or longitudinal symmetry axis of the sectional bodies 1, 2 (cf. FIG. 2, item 3, 4) provides on both sides, in mirror-image arrangement, one tangential air-inlet duct 5, 6 each, through which the combustion air 7 flows into the interior space of the burner, i.e. into the conical hollow space 8. The two conical sectional bodies 1, 2 each have a cylindrical initial part 9, 10, which parts likewise run offset from one another in a manner analogous to the aforesaid sectional bodies 1, 2, so that the tangential air-inlet ducts 5, 6 are present over the entire length of the burner. A nozzle 11, preferably for the atomization of a liquid fuel 12, is accommodated in the region of the cylindrical initial part in such a way that the injection of the liquid fuel 12 coincides approximately with the narrowest cross section of the conical hollow space 8 formed by the sectional bodies 1, 2. The injection capacity and the mode of operation of this nozzle 11 depend on the predetermined parameters of the respective burner. The fuel 12 injected through the nozzle 11 may be enriched with a recycled exhaust gas if required; it is then also possible to make provision for the complementary injection of a quantity of water through the nozzle 11.

It is of course possible for the burner to be designed in a purely conical manner, that is, without cylindrical initial parts 9, 10. Furthermore, the sectional bodies 1, 2 each have a fuel line 13, 14, which fuel lines are arranged along the tangential inlet ducts 5, 6 and are provided with injection openings 15 through which preferably a gaseous fuel 16 is injected into the combustion air 7 flowing past there, as symbolized by arrows 16, this injection at the same time forming the fuel-injection plane (cf. FIG. 2, item 22) of the system. These fuel lines 13, 14 are preferably positioned at the latest at the end of the tangential inflow, before entering the conical hollow space 8, in order to ensure optimum air/fuel mixing.

On the combustion-chamber side, the burner has a front plate 18 serving as anchorage for the sectional bodies 1, 2 and having a number of bores 19 through which mixing or cooling air 20 is fed when required to the front part of the combustion space 17 or its wall.

If liquid fuel 12 is used via the central nozzle 11 for operating the burner, this fuel 12 is injected at an acute angle into the conical hollow space 8 or the combustion space 17. Therefore a conical fuel profile 23 forms from the nozzle 11, which fuel profile is enclosed by the rotating combustion air 7 flowing in tangentially. The concentration of the injected fuel 12 is continuously reduced in the axial direction by the inflowing combustion air 7 to form an optimum mixture. If the burner is operated with a gaseous fuel 16, this may in principle also take place via the fuel nozzle 11, but preferably takes place via the injection openings 15, this fuel/air mixture being formed directly at the end of the air-inlet ducts 5, 6.

During the injection of the liquid fuel 12 via the nozzle 11, the optimum, homogeneous fuel concentration over the cross section is achieved at the end of the burner. If the combustion air 7 is additionally preheated or enriched with a recycled exhaust gas, this provides lasting assistance for the vaporization of the liquid fuel 12, specifically within the premix section induced by the length of the burner.

The same considerations also apply if liquid fuels are now to be fed via the fuel lines 13, 14 instead of gaseous fuels.

Narrow limits per se are to be adhered to in the configuration of the conical sectional bodies 1, 2 with regard to the increase in the cross section of flow as well as to the width of the tangential air-inlet ducts 5, 6 so that the desired flow field of the combustion air 7 can appear at the outlet of the burner. The critical swirl coefficient appears at the outlet of the burner: a backflow zone or backflow bubble 24 (vortex breakdown) also forms there, with a stabilizing effect relative to the flame front 25, acting there, in the sense that the backflow zone 24 performs the function of a bodiless flame retention baffle.

The optimum fuel concentration over the cross section is not achieved until the region of the vortex breakdown, that is, in the region of the backflow zone 24. Not until this point is a stable flame front 25 then produced. The flame-stabilizing effect results from the swirl coefficient, forming in the conical hollow space 8, in the direction of flow along the cone axis. Therefore, on account of this fluidic specification, flashback of the flame into the interior of the burner does not occur.

In general, it may be said that minimizing the throughflow opening of the tangential air-inlet ducts 6, 7 is precisely the measure for forming the backflow zone 24 from the end of the premix section. Furthermore, the construction of the burner is especially suitable for changing the throughflow opening of the tangential air-inlet ducts 5, 6 according to requirements, whereby a relatively large operational range can be covered without changing the overall length of the burner. The sectional bodies 1, 2 may of course also be displaced relative to one another in another plane, as a result of which the sectional bodies 1, 2, as apparent from FIG. 2, may even be overlapped in the region of the tangential air-inlet ducts 5, 6 relative to the air-inlet plane leading into the conical hollow space 8 (cf. FIG. 2, item 21). It is then also possible to nest the sectional bodies 1, 2 spirally one inside the other by a contra-rotating movement.

Due to a more homogeneous mixture formation between the injected fuels 12, 16 and the combustion air 7, which mixture formation can be achieved in this burner, lower flame temperatures and thus lower pollutant emissions, in particular lower NOx, are achieved. These lower temperatures then reduce the thermal loading on the material at the burner front and consequently a special treatment of the surface, for example, is not absolutely necessary.

As far as the number of air-inlet ducts is concerned, the burner is not restricted to the number shown. A larger number, for example, is appropriate where the aim is to apply wider premixing or to accordingly influence the swirl coefficient and thus the formation of the backflow zone 24, this formation depending on the swirl coefficient, by a larger number of air-inlet ducts. In this connection, reference is made to U.S. Pat. No. 5,588,826 to Dobbeling et al., this publication being an integral part of the present description.

FIG. 2 shows the same burner according to FIG. 1, but from another perspective and in simplified form. FIG. 2 is mainly intended to show the disposition of the two conical sectional bodies 1, 2 and their mutual offset. The mutual offset of the respective center axis 3, 4 of the two sectional bodies, relative to the main center axis 26 of the burner, which corresponds to the main axis of the central fuel nozzle 11, produces the respective size of the throughflow openings of the tangential air-inlet ducts 5, 6. Here, the center axes 3, 4 run parallel to one another. Furthermore, it can be seen from this figure that there is in each case a zone 27 belonging to each sectional body 1, 2, in which zones means for injecting supplementary air are placed. For the particular configurations of these means, reference is made to the following FIGS. 3–7.

Figure 3:
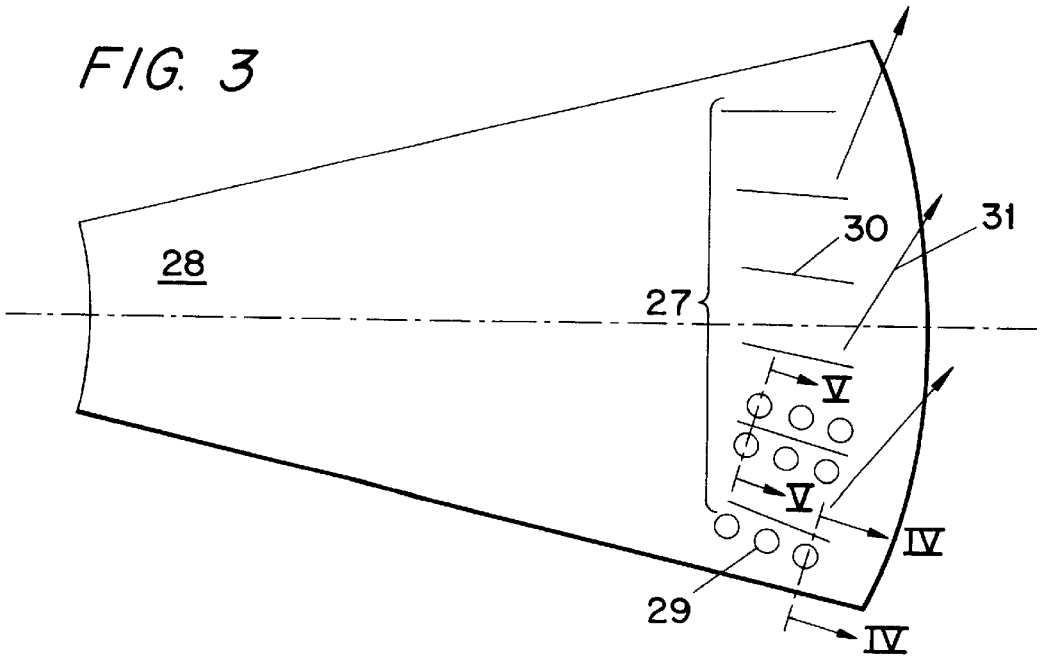
FIG. 3 shows a development of a sectional body with injection openings for supplementary air.

FIG. 3 shows a development 28 of a conical sectional body, in which the zone 27 is shown schematically, a certain configuration of injection openings for supplementary air, which ensure a flashback barrier, being used as a basis within this zone 27. The orientation of the injection openings 29 as well as their number and size is adapted to the respective flow conditions in the burner. The final purpose is primarily directed toward the flashback barrier. The individual diagonal lines 30 are intended to symbolize the positioning of the individual rows of injection openings 29. The arrows 31 are intended to indicate the outflow direction of the supplementary air, which here runs at right angles to the plane 30 of the injection openings 29. However, this outflow direction may vary from a purely axial direction up to the direction of the main flow. In order to understand the situation better, one single row and one double row each of injection openings 29 are depicted in this development 28. The corresponding sections are then apparent from FIGS. 4 and 5.

FIG. 4 shows the configuration of a single row of injection openings 29. Here, the supplementary air 32 is injected at an acute angle to the swirl flow 7*a*, that is, at a small angle to the inner wall of the corresponding sectional body 2, in order to improve the generation of a film.

FIG. 5 shows a double row of injection openings 29. In principle, the same provisions are made here, as has been described with reference to FIG. 3.

In FIG. 6, the injection openings 33 in the region of the inner wall of the corresponding sectional body 2 run in a fan shape, as is apparent from FIG. 7, which is a plan view.

In principle, a wide variation in the configuration of the injection openings is possible. In the case of flows having a pronounced, intense swirl, restrictions arise with regard to the arrangement of the injection openings. As long as bores are used, the desired injection direction can be established by orienting the bores. Slots, however, must often be segmented for reasons of component strength.

Furthermore, it should be emphasized that the flashback barrier proposed here is not restricted to the burner described here. This flashback barrier always takes effect where premix combustion by generation of a swirl-flow field is taken as a basis.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for operating a combustion chamber with a liquid and/or gaseous fuel, comprising:

at least two hollow conical sectional bodies nested longitudinally in a direction of flow to define a conical interior space, center axes of the sectional bodies being mutually offset so that adjacent walls of the sectional bodies form longitudinally extending air-inlet ducts for a tangentially directed entry of combustion air into the conical interior, wherein combustion air flowing through the air-inlet ducts into the burner forms a swirl flow generating a critical swirl at an outlet of the burner which induces a backflow zone for stabilizing a flame front forming at the outlet, at least one fuel nozzle disposed to inject fuel into the conical space, fuel from the at least one nozzle and the swirl flow forming a combustion mixture, and means for injecting supplementary air into the combustion mixture to dilute the mixture along the burner walls, said means being disposed on at least one zone along the longitudinal extent of the burner.

2. The burner as claimed in claim 1, wherein said means for injecting supplementary air are provided on each sectional body on at least one zone on each sectional body.

3. The burner as claimed in claim 1, further comprising a plurality of spaced-apart fuel nozzles arranged in a region of the tangential air-inlet ducts in the longitudinal extent of the burner.

4. The burner as claimed in claim 1, wherein the conical interior space widens uniformly in the direction of flow.

5. The burner as claimed in claim 1, wherein the conical interior space is formed as one of a diffuser, a diffuser-like profile, a confuser, and a confuser-like profile in the direction of flow.

6. The burner as claimed in claim 1, wherein the sectional bodies are nested spirally one inside the other.

7. The burner as claimed in claim 1, wherein said means for injecting supplementary air includes a plurality of injection openings formed in the sectional bodies in the at least one zone, and wherein an injection direction of the supplementary air is related to a direction of the swirl flow so that film air is formed inside the conical hollow space by the supplementary air.

8. The burner as claimed in claim 7, wherein the injection openings are arranged in a plurality of parallel, spaced apart rows in the at least one zone.

9. The burner as claimed in claim 7, wherein the injection direction of the supplementary air forms an acute angle to the direction of the swirl flow.

* * * * *